US006962186B2

(12) United States Patent
Hsu

(10) Patent No.: US 6,962,186 B2
(45) Date of Patent: Nov. 8, 2005

(54) RETAINING STRUCTURE FOR CORDLESS CONTINUOUS FOLDING BLIND

(75) Inventor: Ben Hsu, Changhua Hsien (TW)

(73) Assignee: Ching Feng Blinds Ind. Co., Ltd., Changhua Hsien (TW)

( * ) Notice: Subject to any disclaimer, the term of this patent is extended or adjusted under 35 U.S.C. 154(b) by 101 days.

(21) Appl. No.: 10/660,515

(22) Filed: Sep. 12, 2003

(65) Prior Publication Data

US 2005/0056380 A1 Mar. 17, 2005

(51) Int. Cl.[7] ..... A47H 5/00

(52) U.S. Cl. ..... 160/84.04; 160/84.01; 160/168.1 R

(58) Field of Search ..... 160/84.04, 84.01, 160/168.1 R, 173 R, 349.2, 178.1 V; 248/229.16; 132/273; 428/156; 24/30.5

(56) References Cited

U.S. PATENT DOCUMENTS 2,347,234 A * 4/1944 Allen ..... 24/457
2,661,058 A * 12/1953 Walker ..... 160/178.3
2,767,113 A * 10/1956 Bower ..... 428/156
2,784,780 A * 3/1957 Evans ..... 160/178.3
4,892,110 A * 1/1990 Harvie ..... 132/273
5,158,127 A * 10/1992 Schumacher ..... 160/84.07
5,342,687 A * 8/1994 Iwai et al. ..... 428/402
5,947,177 A * 9/1999 Kratzer ..... 160/178.1 V

* cited by examiner

*Primary Examiner*—Bruce A. Lev
(74) *Attorney, Agent, or Firm*—Troxell Law Office, PLLC

(57) ABSTRACT

A retaining structure for a cordless continuous folding blind includes an upper beam, a continuous folding blind attached to the bottom of the upper beam, and a retaining plate fixed at opposing ends of a bottommost slat of the continuous folding blind via a fastening agent or seamed to the bottommost slat. The retaining plate has an extending section protruding outwards at each outer edge of the bottommost slat and a flexible counterweight stick securely fixed at an inner central section. The retaining plate is selectively bent and folded inwards to abut against a predetermined number of collected slats of the folding blind to locate the blind in a predetermined position.

3 Claims, 4 Drawing Sheets

RETAINING STRUCTURE FOR CORDLESS CONTINUOUS FOLDING BLIND

BACKGROUND OF THE INVENTION

The present invention is related to a retaining structure for a cordless continuous folding blind, including an upper beam, a continuous folding blind attached to the bottom of the upper beam thereof, and a retaining plate fixed at both ends of the bottommost slat of the continuous folding blind thereof respectively. The retaining plate has an extending section protruding outwards at the outer edge of the continuous folding blind thereof, and a flexible counterweight stick securely fixed at the inner central section thereof; whereby, the continuous folding blind thereof collected from bottom to top at a desirable position is firmly located via the extending section of the retaining plate bent and folded inwards to abut tightly against the collected folding blind, preventing the retaining plate from getting loose or detaching there-from when under the swing of strong wind. Besides, no other places are required to keep the retaining plate thereof when not in use.

Please refer to FIG. 1. A conventional retaining structure for a continuous folding blind is made up of an upper beam 10, a continuous folding blind 11 attached to the bottom of the upper beam 10 thereof, and a flexible clip 12 having a cavity 121 defined thereon. When the continuous folding blind 11 is collected to the desired position, the flexible clip 12 is applied and pushed from one side of the continuous folding blind 10 to clamp the gathered slats of the folding blind 10 at the cavity 121 therein for location thereof.

There are some drawbacks to such conventional retaining structure of a continuous folding blind. Most of all, the flexible clip 12 is separately applied onto the continuous folding blind 11 from outside. Once under the swing of strong wind, the flexible clip 12 is easily detached from the continuous folding blind 11, disarraying the gathered continuous folding blind 11. Besides, when the continuous folding blind 11 is fully unfolded in display, the flexible clip 12, not in use, must be inconveniently kept in other places for storage.

SUMMARY OF THE PRESENT INVENTION

It is, therefore, the primary purpose of the present invention to provide a retaining structure for a cordless continuous folding blind, including an upper beam, a continuous folding blind attached to the bottom of the upper beam thereof, and a retaining plate attached at both ends of the bottommost slat of the continuous folding blind thereof respectively; whereby, an extending section of the retaining plate is bent and folded inwards via a flexible counterweight stick disposed at the inner center of the retaining plate thereof to firmly locate the continuous folding blind collected from bottom to top at a desirable position, preventing the retaining plate thereof from getting loose or detaching there-from when under the swing of strong wind. Besides, the retaining plate is integrally attached to the continuous folding blind so that no other places are required to keep the retaining plate thereof when not in use.

DETAILED DESCRIPTION OF THE PREFERRED EMBODIMENTS

Figure 1:
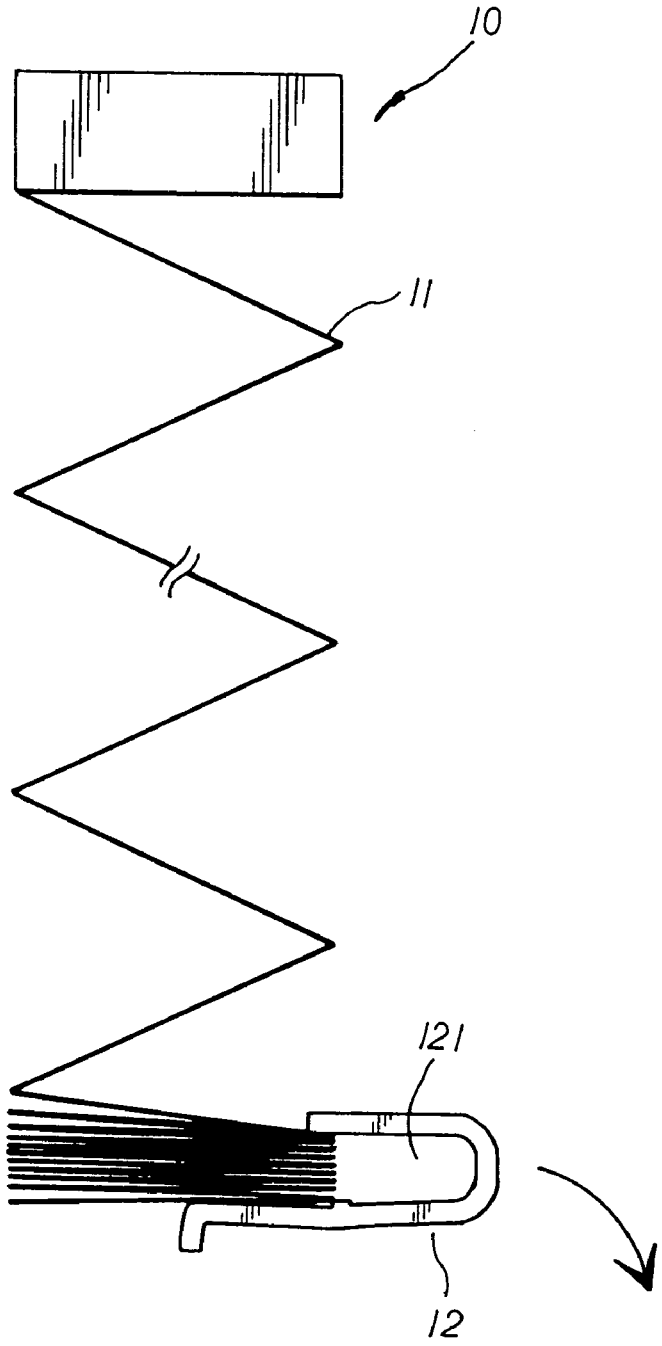
FIG. 1 PRIOR ART
FIG. 1 is a sectional view of a conventional retaining structure of a cordless continuous folding blind in use.
Figure 2:
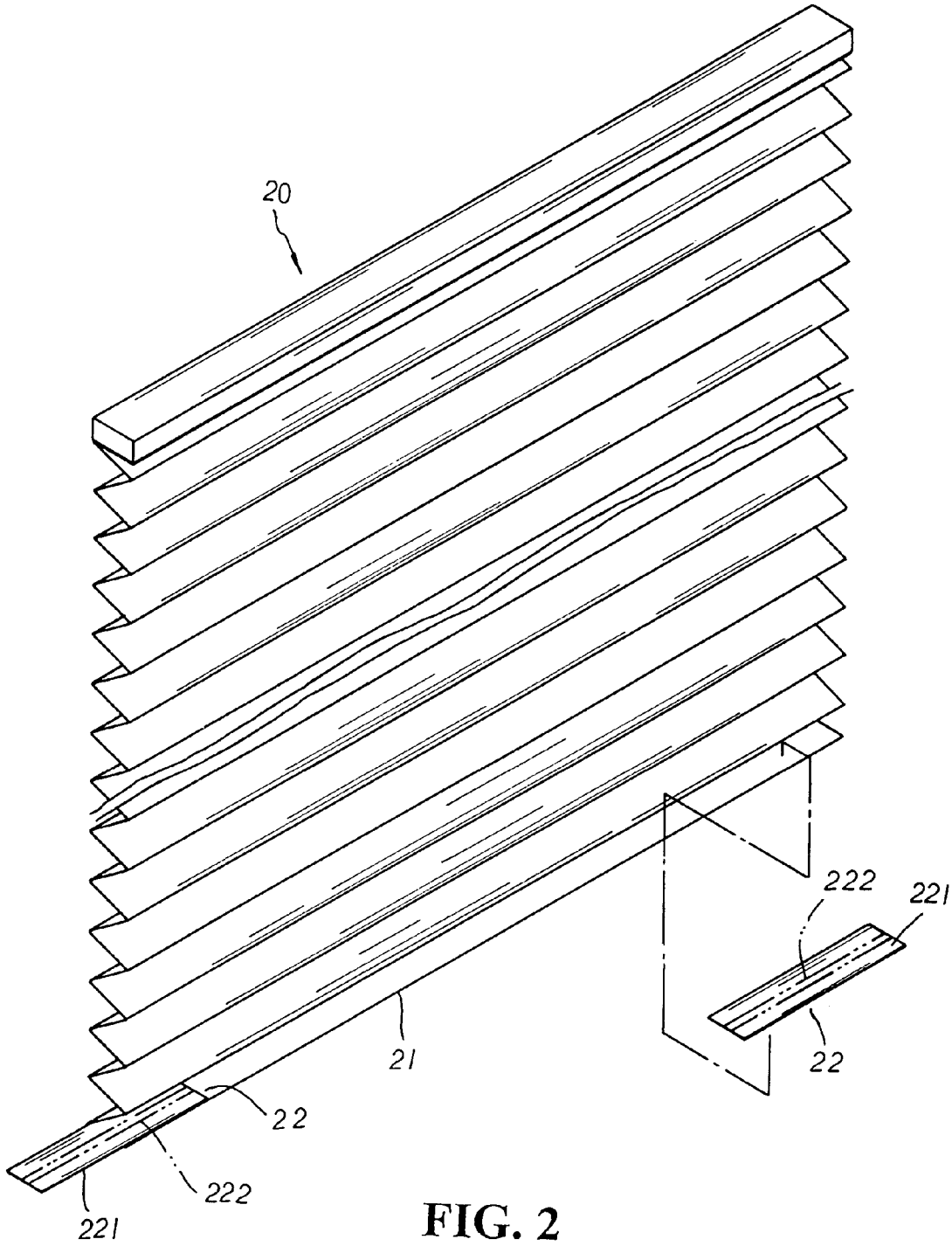
FIG. 2 is a perspective exploded view of the present invention.

Please refer to FIG. 2. The present invention is related to a retaining structure for a cordless continuous folding blind, comprising an upper beam 20, a continuous folding blind 21 attached to the bottom of the upper beam 20 thereof, and a retaining plate 22 fixed at both ends of the bottommost slat of the continuous folding blind 21 thereof respectively. The retaining plate 22 has an extending section 221 protruding outwards at the outer edge of the continuous folding blind 21 thereof, and a flexible counterweight stick 222 securely fixed at the inner central section thereof. Besides, the retaining plate 22 thereof can be stuck onto the continuous folding blind 21 via a fastening agent or seamed thereto for secure location thereon.

Figure 3:
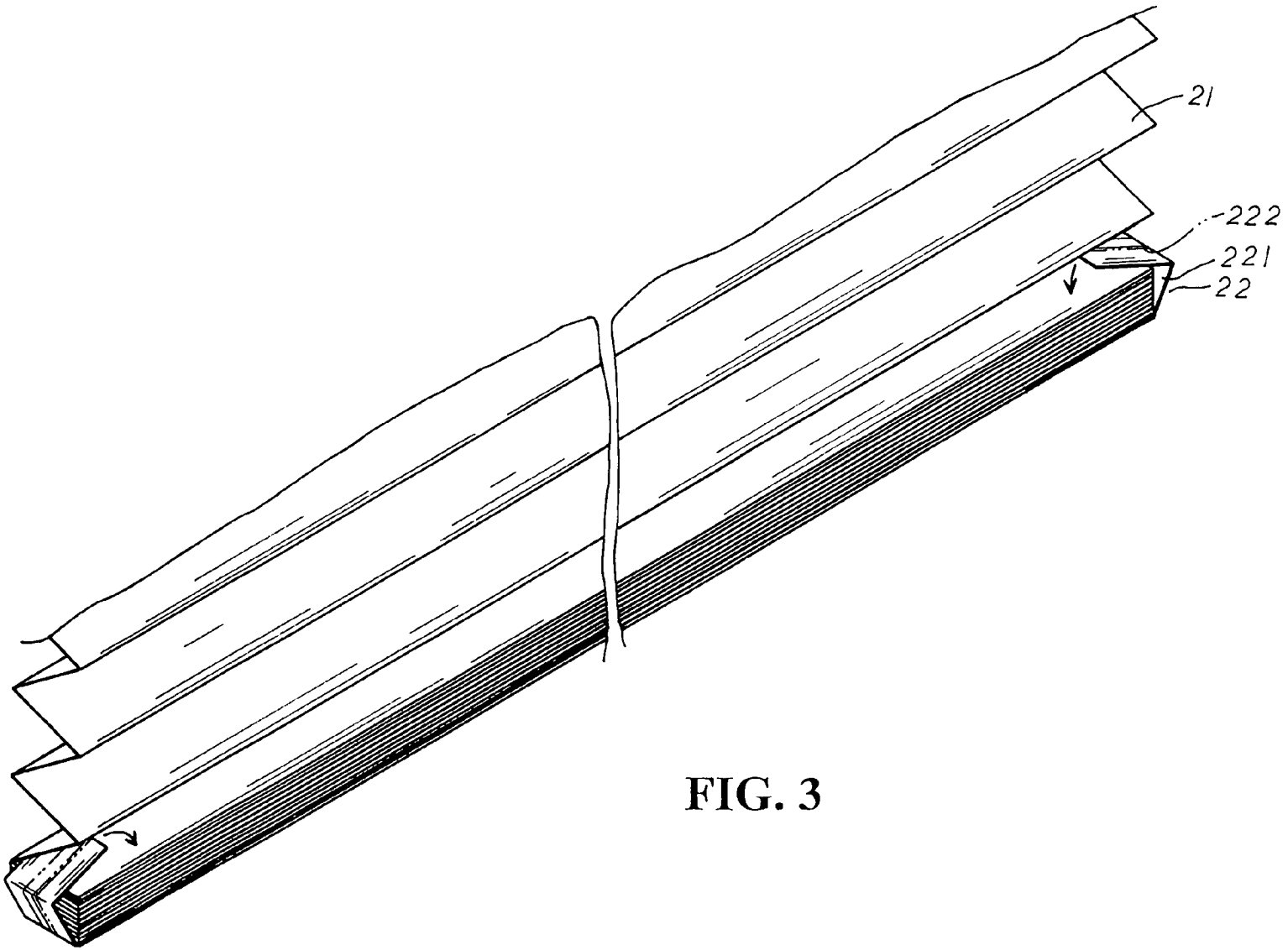
FIG. 3 is a perspective view of the present invention in operation.
Figure 4:
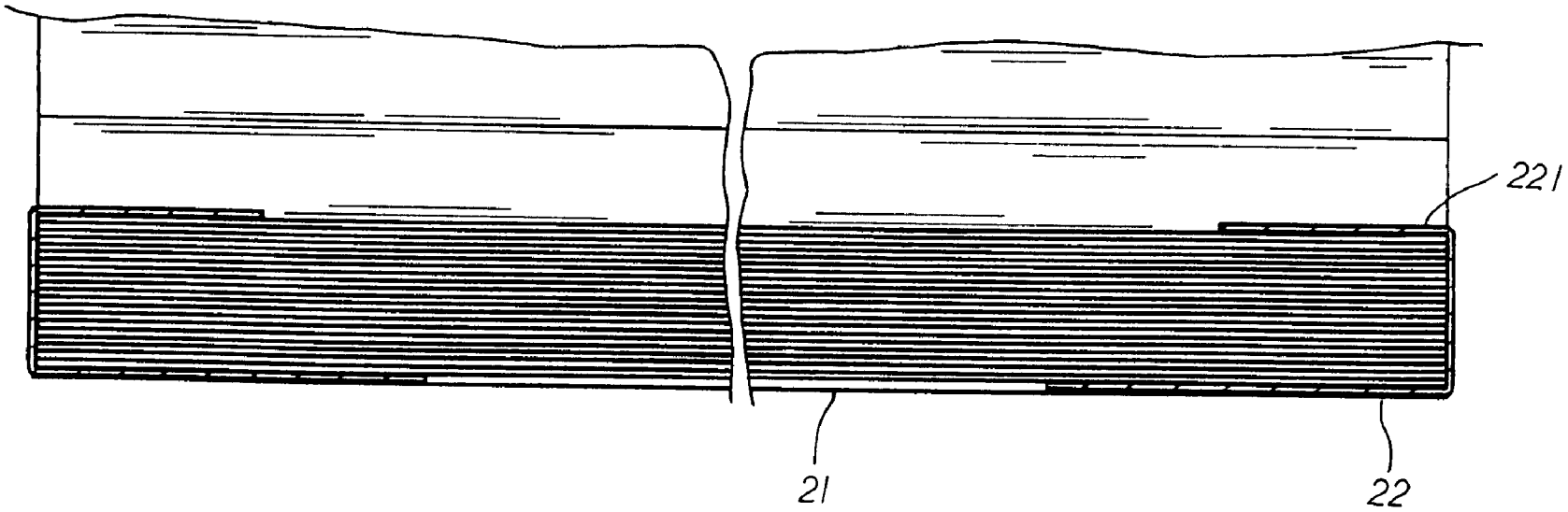
FIG. 4 is a sectional view of the present invention in practical use.

Please refer to FIG. 3. To collect the continuous folding blind 21, the continuous folding blind 21 thereof is gathered from bottom to top till a desirable position is reached. The extending section 221 of the retaining plate 22 is bent upwards in a right angle and folded inwards via the flexible counterweight stick 222 to abut against the top surface of the collected continuous folding blind 21, clamping tight the gathered slats of the folding blind 21 thereof for secure location thereof as shown in FIG. 4. Thus, even under the swing of strong wind, the retaining plate 22 can firmly collect and locate the continuous folding blind 21 at a desirable position without getting loose or detaching there-from. Besides, in case the continuous folding blind 21 is fully unfolded, the retaining plate 22 is integrally attached to the folding blind 21 thereof without any other places required to keep the retaining plate 22 thereof when not in use.

What is claimed is:

1. A cordless continuous blind comprising:

a) an upper beam;

b) a continuous folding blind connected at a top thereof to a bottom of the upper beam and having a plurality of slats; and c) two retaining plates, each of the two retaining plates having:

i) a secured section fixedly connected to one of two opposing ends of a bottommost slat of the plurality of slats;

ii) an extending section; and iii) a flexible counter weight stick located along a center of a length thereof, wherein each of the two retaining plates is movable between open and clamped positions, in the clamped position, each extending section is bent around a predetermined number of the plurality of slats clamping the predetermined number of the plurality of slats between each extending section and each secured section, and, in the open position, the extending section extends outwardly from the continuous folding blind.

2. The cordless continuous blind according to claim 1, wherein each of the two retaining plates is sewn to the bottommost slat of the continuous folding blind.

3. The cordless continuous blind according to claim 1, further comprising a fastening agent fixedly connecting each of the two retaining plates to the bottommost slat of the continuous folding blind.

* * * * *